US005726546A

United States Patent [19]

Harwood

[11] Patent Number: 5,726,546

[45] Date of Patent: Mar. 10, 1998

[54] AGITATION PERIOD CONTROL OF LAUNDRY MACHINE MOTOR

[75] Inventor: Jonathan David Harwood, Manurewa, New Zealand

[73] Assignee: Fisher & Paykel Limited, Auckland, New Zealand

[21] Appl. No.: 680,250

[22] Filed: Jul. 11, 1996

[30] Foreign Application Priority Data

Jul. 17, 1995 [NZ] New Zealand ..... 272589

[51] Int. Cl.[6] ..... H02P 6/02

[52] U.S. Cl. ..... 318/439; 318/254; 318/281; 318/285; 68/12.02

[58] Field of Search ..... 318/138, 254, 318/439, 280–300; 68/12.01, 12.02

[56] References Cited

U.S. PATENT DOCUMENTS

| | | | |
|---|---|---|---|
| 3,599,062 | 8/1971 | Crane | 318/281 |
| 4,540,921 | 9/1985 | Boyd, Jr. et al. | 318/254 |
| 4,857,814 | 8/1989 | Duncan | 318/281 |
| 5,341,452 | 8/1994 | Ensor | 388/811 |
| 5,398,298 | 3/1995 | Ensor | 388/811 |

*Primary Examiner*—David S. Martin
*Attorney, Agent, or Firm*—Trexler, Bushnell, Giangiorgi & Blackstone, Ltd.

[57] ABSTRACT

A laundry washing machine in which the period of each agitation stroke (comprising "ramp", "plateau" and "coast" phases) is controlled by adjusting the "coast" phase of each stroke in order to maintain consistent washing performance. The "coast" phase is initiated (after a predetermined period has elapsed in the "plateau" phase) by starting a timer and allow the motor to coast until the motor velocity drops to a predetermined reversal velocity at which point the motor is reversed to begin the next agitation stroke. The value of the timer when the velocity reaches the reversal velocity is compared to a desired value or range of values. The predetermined value of the reversal velocity is increased if the timer value is greater than the desired value or range of values. Alternately, the value of the reversal velocity is decreased if the timer value is less than the desired value or range of values. The period of the coast phase of the next agitation stroke should then be closer to the desired period.

13 Claims, 3 Drawing Sheets

AGITATION PERIOD CONTROL OF LAUNDRY MACHINE MOTOR

FIELD OF THE INVENTION

This invention relates to laundry washing machines and in particular, though not solely, to the control of motor speed in a laundry washing machine during the agitation part of a washing cycle order to maintain the period of agitation wthin an acceptable limit dependent of laundry load size and washing fluid level.

DESCRIPTION OF THE PRIOR ART

During the agitation part of a laundry washing cycle of some laundry machines a controller controls the power supplied to the motor in order to maintain motor velocity in accordance with a predetermined velocity profile. An agitation velocity profile for one stroke may have for example three parts, (i) ramp up from zero velocity, (ii) plateau at a fixed velocity, and (iii) coast back to zero velocity.

At the end of each stroke the direction of rotation is changed.

One example of such a laundry machine is disclosed in our U.S. Pat. No. 4,857,814 to Duncan. In the laundry machine disclosed, the motor velocity profile is set in accordance with user inputs of laundry load volume and required wash vigorousness (for example "heavy duty" or "gentle"). In this way soil removal and washing action remain constant according to the user setup, even for different load sizes.

A more recent example of a laundry machine in which motor velocity follows a predetermined velocity profile during agitation is disclosed in our U.S. Pat. No. 5,341,452 to Ensor. The laundry machine disclosed uses motor velocity profiles similar in shape to that disclosed in U.S. Pat. No. 4,857,814 but the laundry machine senses the actual load on the motor due to the laundry load on the agitator blades. Motor power is adjusted in discrete PWM (Pulse Width Modulation) steps to maintain speed in accordance with a velocity profile selected in response to user inputs.

In each of the above laundry machines, the total stroke time (ramp time+plateau time+coast time) is variable due to the unpredictable length of time that the motor will accelerate in the ramp part and/or coast before the motor direction is reversed and power reapplied to the motor windings to commence the next agitation stroke. Preferably, consecutive agitation strokes should last for substantially the same length of time to maintain uniform wash performance.

It is, therefore, an object of the present invention to provide a method of controlling the period of an agitation stroke of a laundry machine which goes some way towards overcoming the above disadvantages or which will at least provide the public with a useful choice.

BRIEF SUMMARY OF THE INVENTION

Accordingly, in a first aspect, the invention consists in a method of controlling the period of an agitation stroke during an agitation phase of a washing cycle in a laundry washing machine having:

a rotatable spin tub for receiving a load of laundry to be washed, within a stationary water container, an electronically commutated motor connected to a shaft extending through and sealed against said water container and having an agitator mounted thereon within said spin tub, control means controlling said operation of said motor throughout a washing cycle, said control means controlling commutation of said motor, receiving velocity feedback from said motor and occasionally causing said laundry machine to enter an agitation phase of said washing cycle, said method comprising the steps of:

i) commencing an agitation stroke by providing a commutation sequence to said motor which accelerates said motor to a predetermined plateau speed, ii) maintaining said plateau speed for a predetermined length of time, iii) removing power from said motor and allowing said motor to commence coasting towards zero rotational velocity, iv) starting a timer to determine the length of time said motor coasts before the rotational velocity drops to a predetermined reversal velocity at which time said commutation sequence is reversed and said timer is stopped providing a measured coast time, v) comparing said measured coast time to a predetermined preferred coast period and incrementing said predetermined reversal velocity if said measured coast time is greater than said preferred coast period and, vi) reversing the direction of said motor and repeating steps (i) to (vi) until said agitation phase is completed.

In a second aspect the invention consists in control means for controlling the operation of a laundry washing machine motor during an agitation phase of a laundry washing cycle, said agitation phase having a number of agitation strokes each of which is divided into a ramp segment, a plateau segment and a coast segment and said laundry washing machine having:

a stationary water container, a rotatable spin tub, for receiving a load of laundry to be washed, within said stationary water container, a shaft extending through and sealed against said water container and having an agitator mounted thereon within said spin tub, an electronically commutated motor (ECM) connected to said shaft, an agitator located within said spin tub and mounted on said shaft, said controller comprising:

commutation means which energise said motor by applying a selected commutation sequence to the motor windings at a determined time in order to rotate said shaft in a required direction and which rotates said shaft in an opposite direction upon application of an opposite commutation sequence, velocity sensing means which determine the velocity of said motor, timing means which, during said coast segment of each said agitation stroke, determine the length of time (measured coast time) that said motor coasts before said velocity sensing means sense that the velocity of said motor has dropped to a predetermined reversal velocity at which time said commutation means apply said opposite commutation sequence to said motor windings in order to reverse the direction of rotation of the motor, algebraic comparison and adding means which compare said measured coast time to a predetermined preferred coast period and increment said predetermined reversal velocity if said measured coast time is greater than said preferred coast period so that the next measured coast time will be closer to or the same as said predetermined coast time.

In a third aspect the invention consists in a laundry washing machine which carries out a laundry washing cycle including an agitation phase having a number of agitation strokes each of which is divided into a ramp segment, a plateau segment and a coast segment comprising:

a stationary water container, a rotatable spin tub, for receiving a load of laundry to be washed, within said stationary water container, a shaft extending through and sealed against said water container and having an agitator mounted thereon within said spin tub, an electronically commutated motor (ECM) connected to said shaft, an agitator located within said spin tub and mounted on said shaft, said controller comprising:

commutation means which energise said motor by applying a selected commutation sequence to the motor windings at a determined time in order to rotate said shaft in a required direction and which rotates said shaft in an opposite direction upon application of an opposite commutation sequence, velocity sensing means which determine the velocity of said motor, timing means which, during said coast segment of each said agitation stroke, determine the length of time (measured coast time) that said motor coasts before said velocity sensing means sense that the velocity of said motor has dropped to a predetermined reversal velocity at which time said commutation means apply said opposite commutation sequence to said motor windings in order to reverse the direction of rotation of the motor, algebraic comparison and adding means which compare said measured coast time to a predetermined preferred coast period and increment said predetermined reversal velocity if said measured coast time is greater than said preferred coast period so that the next measured coast time will be closer to or the same as said predetermined coast time.

BRIEF DESCRIPTION OF THE DRAWINGS

The invention consists in the foregoing and also envisages constructions of which the following gives examples.

One preferred form of the present invention will now be described with reference to the accompanying drawings in which.

DETAILED DESCRIPTION OF THE INVENTION

Figure 1:
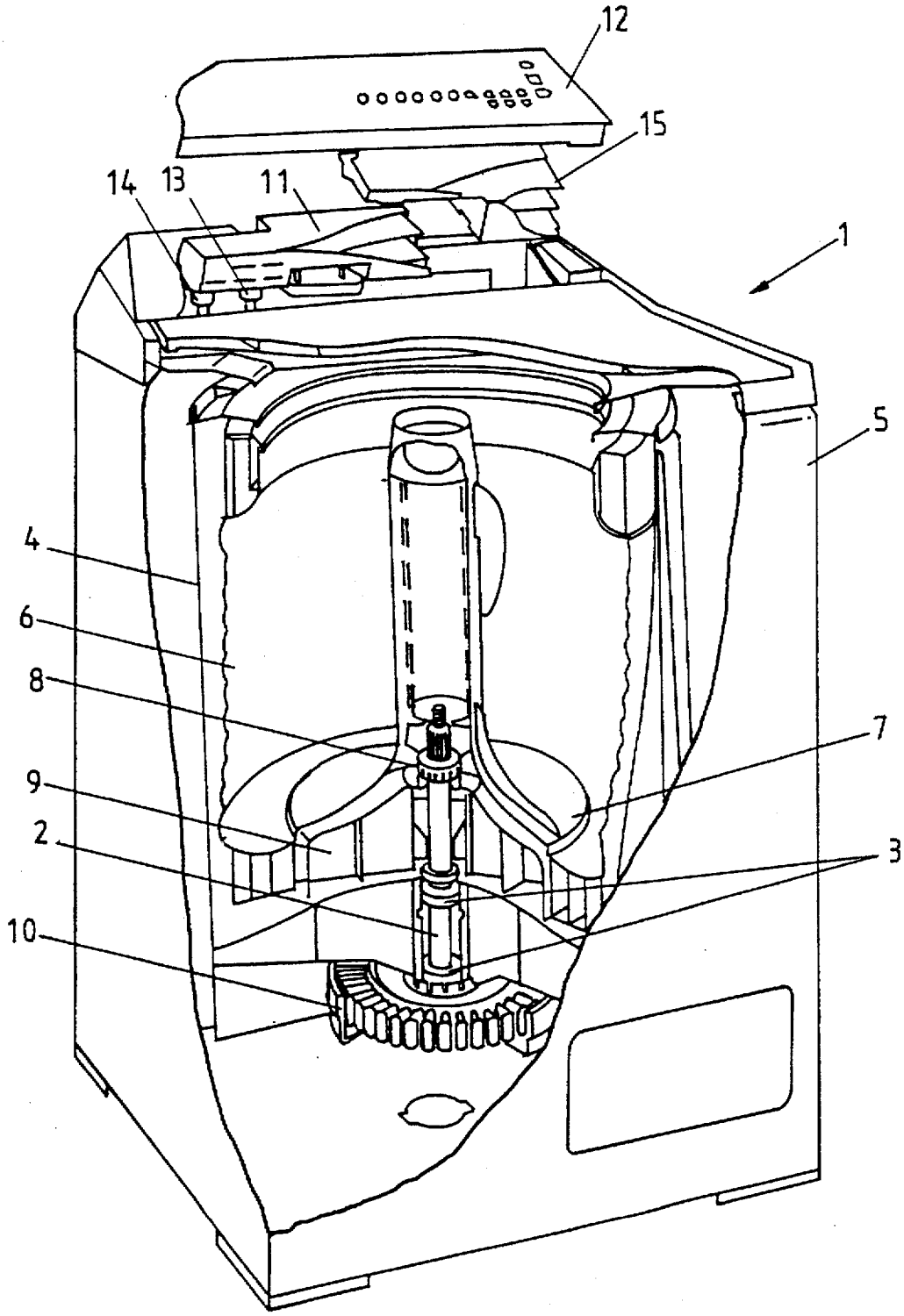
FIG. 1 is a partially cut away, partially exploded perspective view of a laundry washing machine of the type suitable for operation with the present invention.

With reference to FIG. 1, a laundry washing machine 1 is shown with a shaft 2 mounted on a vertical axis. The shaft 2 is rotatable in a pair of vertically spaced beatings 3 which are mounted in the base of a stationary water container 4 suspended from an upper part of a cabinet 5. An electric motor 10, preferably an "inside out" electronically commutated motor (ECM), is preferably mounted directly on the lower end of shaft 2 and driven by a power supply and motor controller 11. The motor could alternatively be a more traditional type internal rotor motor mounted on the laundry washing machine frame with a belt connecting the motor rotor to shaft 2.

Within water container 4 and rotatable by shaft 2 is a spin tub 6 which in use holds a load of laundry during operation of washing machine 1 and which is free to move (within limits) up and down on shaft 2. Within spin tub 6 and fixed to the splined upper end of shaft 2 is an agitator 7 which may be rotated independently of spin tub 6 for an oscillatory agitation phase of a washing cycle, or in conjunction with the spin tub 6 during a spin phase. Interconnection of spin tub 6 and agitator 7 is determined by the state of a dog clutch 8 which comprises two sets of interlocking teeth coaxial with shaft 2, one upwardly facing set on the shaft and the other downwardly facing set on the spin tub base. The two sets of opposing teeth being interconnected when a sufficient level of washing fluid is admitted to the water container to cause floatation chambers 9 in the base of spin tub 6 to provide an upward buoyancy force to spin tub 6 sufficient to overcome the downwardly directed weight of the spin tub and clothes load.

The laundry washing machine has a controller 15 which may include a microprocessor with inputs receiving information from transducers (not shown) in various parts of the machine including, for example, water temperature, motor speed, agitator position and user settings from push buttons on control panel 12 which may be used to set desired wash parameters in respect of, for example, water level, water temperature, maximum spin speed and wash vigorousness. Controller 15 also includes algebraic comparison and adding means, the function of which is set out below. In turn, the controller 15 carries out a series of instructions which may be in the form of a software program held in a memory (for example EEPROM) device connected to the microprocessor. Controller 15 thereby controls the functions of the laundry washing machine during operation for example supplying power to motor 10 at various levels by (for example Pulse Width Modulating the motor supply voltage), controlling opening and closing of water inlet valves 13 and 14 and operation of an outlet pump (not shown) to empty the machine of washing fluid when required.

In use the laundry washing machine 1 is controlled by control means 15 to carry out a washing cycle which usually comprises the steps (or phases) of:

i) filling the water container with washing fluid (water and detergent) to a suitable level, ii) washing the clothes load by oscillatory motion of the agitator, iii) draining the washing fluid and spinning the clothes load to extract further washing fluid, iv) refilling the water container with water to remove more residual detergent from the clothes load, v) draining and spinning to remove excess water.

The above process may involve further agitation phases or may involve "spray rinse" phases, which replace the so called "deep rinse" (step (iv)) to save water by rotating the spin tub during the admission of rinsing water.

Figure 3:
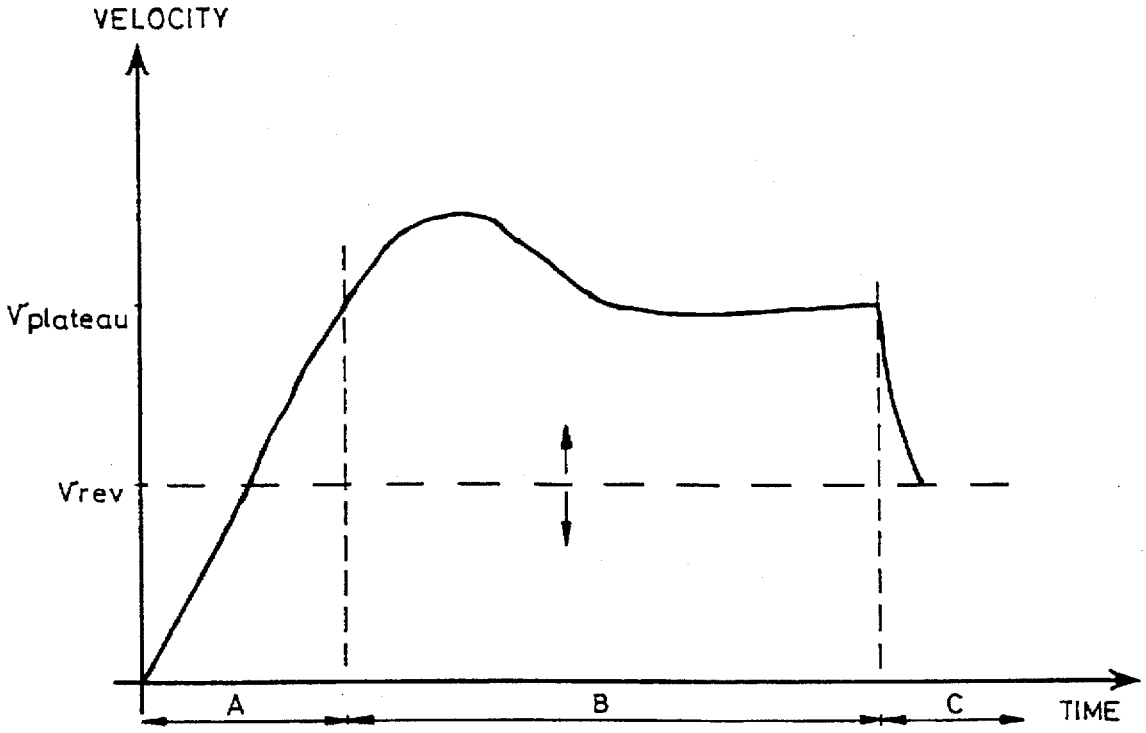
FIG. 3 is a graph of velocity versus time ("velocity profile") for one agitation stroke of the laundry washing machine shown in FIG. 1 operating in accordance with the flow chart of FIG. 2.

Each of the agitation phases comprise a number of agitation strokes in alternating directions. Each stroke is performed in accordance with a predetermined velocity profile which sets the desirable velocity of the motor throughout the entire stroke. A typical velocity for one agitation stroke comprises three distinct segments as shown in FIG. 3:

i) ramp up from standstill to a plateau velocity (section A), ii) maintaining plateau velocity for a set time (section B), and iii) removing motor power and coasting the motor towards zero velocity (section C).

By controlling motor agitation velocity in accordance with a particular velocity profile, a consistent washing performance will be achieved from stroke to stroke. Due to washing load bunching, loading on the agitator blades is not constant or predictable and therefore the coast time is widely variable even for consecutive agitation strokes depending on the inertia of the coasting clothes load/washing fluid mixture. To improve consistency and to maintain a desirable washing pattern, coast time is controlled by the present invention as will soon be described.

Reference is made to our prior U.S. Pat. No. 4,857,814 to Duncan which discloses a laundry washing machine motor control system in which the motor speed is controlled in accordance with such a velocity profile and the disclosure thereof is included herein by reference. Reference is also made to our prior U.S. Pat. No. 5,341,452 which discloses a laundry washing machine in which the ramp up portion of the agitation stroke is divided into a series of incremental velocity steps by incremental power increases to the motor. The number of steps is related to the size of the particular load. The disclosure of U.S. Pat. No. 5,341,452 is also included herein by reference.

Figure 2:
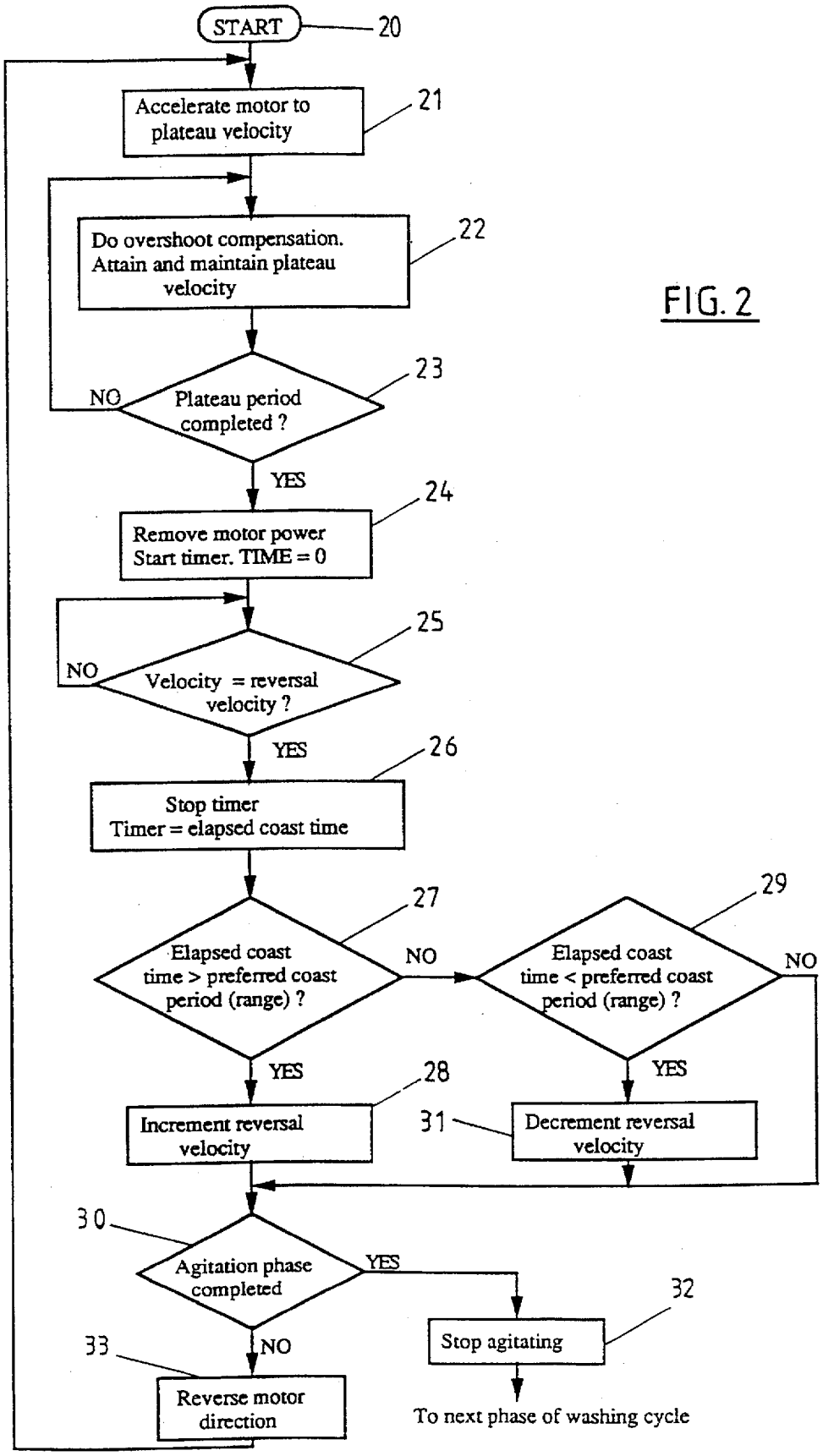
FIG. 2 is a flow chart demonstrating the operation of the laundry washing machine of FIG. 1 in accordance with the present invention.

With reference now to FIG. 2, a flow chart detailing the preferred operation of the controller 15 to carry out the present invention is shown. It should be noted that the flow chart of FIG. 2 is merely one part of the instructions required to control laundry washing machine 1 during the entire washing cycle. FIG. 2 represents the instructions required to carry out the agitation phase of a washing cycle in accordance with the present invention.

In FIG. 2 control begins at block 20 (usually after the laundry washing machine has completed a fib phase and the laundry load is floating (or submerged) in a suitable volume of water and possibly detergent). The motor is accelerated at block 21 (preferably incrementally as disclosed in our U.S. Pat. No. 5,341,452) up to a plateau velocity $V_{plateau}$. Due to the inertia of spin tub 6 and rotating laundry load, velocity overshoot will occur and at block 22 motor velocity is controlled down to the required plateau velocity which is maintained for a predetermined time. At the end of the plateau region, decision block 23 exits a loop so that control passes to block 24 where power is removed from the motor and a timer is started from zero to determine the length of the coast segment of the agitator stroke.

At decision block 25 the algebraic comparison and adding means of controller 15 compares the present motor velocity to a predetermined reversal velocity value $V_{rev}$, stored in a counter in memory (preferably $V_{rev}=\frac{1}{2}V_{plateau}$). Once the motor velocity drops to the predetermined reversal velocity, the timer is stopped at block 26. It should be noted that the reversal velocity could also comprise a range of velocities preferably centred around about $\frac{1}{2}V_{plateau}$.

At decision block 27 the elapsed coast time from the timer is compared to the coast period from memory. If the measured coast time is greater than the desired coast period (or range of periods) then control passes to block 28 where the previous value of reversal velocity is incremented by the algebraic comparison and adding means of controller 15 so that on the next agitation stroke the measured coast time should be closer to the desired coast period before passing control to block 30.

If the decision in block 27 reveals that the measured coast time is less than or equal to the desired coast period then decision block 29 passes control to block 30 if the measured coast time equals (or falls within the range of) the desired coast period. If, however, decision block 29 reveals that the measured coast time is less than the desired coast period (or range of periods) then at block 31 the reversal velocity from memory is decremented by the algebraic comparison and adding means of controller 15 so that the next coast time from the next agitation stroke will be closer to or lie within the desired range.

At decision block 30, if the agitation phase of the washing cycle is completed (for example by the sum of the measured agitation stroke times exceeding a predetermined time limit) then agitation is stopped at block 32 and control passes to a subsequent cycle in the washing cycle as previously stated.

If, however at block 30, the agitation phase is not yet complete, then motor direction is reversed at block 33 and power reapplied to the motor windings at block 21 where the above described process is repeated until the end of the agitation phase.

Thus it can be seen, at least in the preferred embodiment, that the present invention provides a convenient method of ensuring that coast periods of consecutive agitation strokes are consistent in length and that total stroke periods can thereby be controlled to within acceptable limits for any water level.

We claim:

1. A method of controlling the period of an agitation stroke during an agitation phase of a washing cycle in a laundry washing machine having:

a rotatable spin tub for receiving a load of laundry to be washed, within a stationary water container;

an electronically commutated motor connected to a shaft extending through and sealed against said water container and having an agitator mounted thereon within said spin tub;

control means controlling said operation of said motor throughout a washing cycle, said control means controlling commutation of said motor, receiving velocity feedback from said motor and occasionally causing said laundry machine to enter an agitation phase of said washing cycle, said method comprising the steps of:

i) commencing an agitation stroke by providing a commutation sequence to said motor which accelerates said motor to a predetermined plateau speed;

ii) maintaining said plateau speed for a predetermined length of time, iii) removing power from said motor and allowing said motor to commence coasting towards zero rotational velocity;

iv) starting a timer to determine the length of time said motor coasts before the rotational velocity drops to a predetermined reversal velocity at which time said commutation sequence is reversed and said timer is stopped providing a measured coast time;

v) comparing said measured coast time to a predetermined preferred coast period and incrementing said predetermined reversal velocity if said measured coast time is greater than said preferred coast period and;

vi) reversing the direction of said motor and repeating steps (i) to (vi) until said agitation phase is completed.

2. A method of controlling the period of an agitation stroke as claimed in claim 1 wherein said preferred reversal velocity is about half said plateau velocity.

3. A method of controlling the period of an agitation as claimed in claim 1 or claim 2 wherein said step of comparing the measured coast time to a predetermined preferred coast period also includes decrementing said predetermined reversal velocity if said measured coast time is less than said preferred coast period.

4. Control means for controlling the operation of a laundry washing machine motor during an agitation phase of a laundry washing cycle, said agitation phase having a number of agitation strokes each of which is divided into a ramp segment, a plateau segment and a coast segment and said laundry washing machine having:

a stationary water container;

a rotatable spin tub, for receiving a load of laundry to be washed, within said stationary water container;

a shaft extending through and sealed against said water container and having an agitator mounted thereon within said spin tub;

an electronically commutated motor (ECM) connected to said shaft;

an agitator located within said spin tub and mounted on said shaft;

said controller comprising;

commutation means which energize said motor by applying a selected commutation sequence to the motor windings at a determined time in order to rotate said shaft in a required direction and which rotates said shaft in an opposite direction upon application of an opposite commutation sequence;

velocity sensing means which determine the velocity of said motor;

timing means which, during said coast segment of each said agitation stroke; determine the length of time that said motor coasts before said velocity sensing means sense that the velocity of said motor has dropped to a predetermined reversal velocity at which time said commutation means apply said opposite commutation sequence to said motor windings in order to reverse the direction of rotation of the motor;

algebraic comparison and adding means which compare said measured coast time to a predetermined preferred coast period and increment said predetermined reversal velocity if said measured coast time is greater than said preferred coast period so that the next measured coast time will be closer to or the same as said predetermined coast time.

5. Control means as claimed in claim 4 wherein said algebraic comparison and adding means decrement said predetermined reversal velocity if said measured coast time is less than said preferred coast period.

6. Control means as claimed in claim 4 or claim 5 wherein said algebraic comparison and adding means store a representation of said reversal velocity in a counter which may be increased or decreased depending on the measured coast time and the desired coast period.

7. Control means as claimed in claim 4 or claim 5 wherein said algebraic comparison and adding means comprise a programmed controller means which carries out the steps of comparing said measured coast time to a predetermined preferred coast period and incrementing said predetermined reversal velocity if said measured coast time is greater than said preferred coast period so that the next measured coast time will be closer to or the same as said predetermined coast time.

8. Control means as claimed in claim 7 wherein said timing means form part of said programmed controller means.

9. A laundry washing machine which carries out a laundry washing cycle including an agitation phase having a number of agitation strokes each of which is divided into a ramp segment, a plateau segment and a coast segment comprising:

a stationary water container;

a rotatable spin tub, for receiving a load of laundry to be washed, within said stationary water container;

a shaft extending through and sealed against said water container and having an agitator mounted thereon within said spin tub;

an electronically commutated motor (ECM) connected to said shaft;

an agitator located within said spin tub and mounted on said shaft;

said controller comprising:

commutation means which energise said motor by applying a selected commutation sequence to the motor windings at a determined time in order to rotate said shaft in a required direction and which rotates said shaft in an opposite direction upon application of an opposite commutation sequence;

velocity sensing means which determine the velocity of said motor, timing means which, during said coast segment of each said agitation stroke, determine the length of time that said motor coasts before said velocity sensing means sense that the velocity of said motor has dropped to a predetermined reversal velocity at which time said commutation means apply said opposite commutation sequence to said motor windings in order to reverse the direction of rotation of the motor;

algebraic comparison and adding means which compare said measured coast time to a predetermined preferred coast period and increment said predetermined reversal velocity if said measured coast time is greater than said preferred coast period so that the next measured coast time will be closer to or the same as said predetermined coast time.

10. A laundry washing machine as claimed in claim 9 wherein said algebraic comparison and adding means decrement said predetermined reversal velocity if said measured coast time is less than said preferred coast period.

11. A laundry washing machine as claimed in claim 9 or claim 10 wherein said algebraic comparison and adding means store a representation of said reversal velocity in a counter which may be increased or decreased depending on the measured coast time and the desired coast period.

12. A laundry washing machine as claimed in claim 9 or claim 10 wherein said algebraic comparison and adding means comprise a programmed controller means which carries out the steps of comparing said measured coast time to a predetermined preferred coast period and incrementing said predetermined reversal velocity if said measured coast time is greater than said preferred coast period so that the next measured coast time will be closer to or the same as said predetermined coast time.

13. A laundry washing machine as claimed in claim 12 wherein said timing means form part of said programmed controller means.

* * * * *